US005992039A

United States Patent [19]

Bunch et al.

[11] Patent Number: 5,992,039

[45] Date of Patent: Nov. 30, 1999

[54] PORTABLE CLOTHES DRYER

[76] Inventors: Kelly C. Bunch, 3644 Sable Palm St., North Las Vegas, Nev. 89030; Eddie L. Bunch, 2640 Rosanna St., Las Vegas, Nev. 89117

[21] Appl. No.: 09/176,838

[22] Filed: Oct. 22, 1998

Related U.S. Application Data

[63] Continuation-in-part of application No. 29/084,887, Mar. 12, 1998.

[51] Int. Cl.[6] ..... F26B 19/00

[52] U.S. Cl. ..... 34/91; 34/602; 34/603

[58] Field of Search ..... 34/90, 91, 202, 34/231, 235, 602, 603, 604, 607; 392/365, 373, 379, 380, 381, 382, 383, 384, 385; 219/221; 248/638, 671, 678, 176.1

[56] References Cited

U.S. PATENT DOCUMENTS

| | | | |
|---|---|---|---|
| 2,787,841 | 9/1957 | Warino | 34/58 |
| 2,793,444 | 5/1957 | Turner | 34/602 |
| 3,259,996 | 7/1966 | Hull et al. | 34/563 |
| 3,357,109 | 12/1967 | Harvey | 34/91 |
| 4,696,116 | 9/1987 | Livingston | 34/108 |
| 5,388,344 | 2/1995 | Wallach | 34/91 |
| 5,443,538 | 8/1995 | Little | 34/91 |

*Primary Examiner*—Henry Bennett
*Assistant Examiner*—Pamela A. Wilson

[57] ABSTRACT

A portable clothes dryer for drying clothing while on vacation or camping. The portable clothes dryer includes a dryer housing with first and second ends, a sidewall extending horizontally between the ends, and an interior that is defined by the sidewall and ends. The first end of the dryer housing has a door for inserting clothing into the interior of the dryer housing. The dryer housing has an inlet aperture extending through it for receiving a blower that has a heating element and a fan coupled to a fan motor. A basket drum is rotatably disposed in the interior of the dryer housing for tumbling clothing. A basket motor is mounted to the dryer housing for rotating the basket drum.

20 Claims, 3 Drawing Sheets

PORTABLE CLOTHES DRYER

This application is a continuation-in-part of my prior design patent application Ser. No. 29/084,887, filed Mar. 12, 1998.

BACKGROUND OF THE INVENTION

1. Field of the Invention

The present invention relates to clothes dryers and more particularly pertains to a new portable clothes dryer for drying clothing while on vacation or camping.

2. Description of the Prior Art

The use of clothes dryers is known in the prior art. More specifically, clothes dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,388,344; 4,406,071; 3,157,475; 4,035,927; 1,544,884; and 5,361,516.

While these devices fulfill their respective, particular objectives and requirements, the aforementioned patents do not disclose a new portable clothes dryer. The inventive device includes a dryer housing with first and second ends, a sidewall extending horizontally between the ends, and an interior that is defined by the sidewall and ends. The first end of the dryer housing has a door for inserting clothing into the interior of the dryer housing. The dryer housing has an inlet aperture extending through it for receiving a blower that has a heating element and a fan coupled to a fan motor. A basket drum is rotatably disposed in the interior of the dryer housing for tumbling clothing. A basket motor is mounted to the dryer housing for rotating the basket drum.

In these respects, the portable clothes dryer according to the present invention substantially departs from the conventional concepts and designs of the prior art, and in so doing provides an apparatus primarily developed for the purpose of drying clothing while on vacation or camping.

SUMMARY OF THE INVENTION

In view of the foregoing disadvantages inherent in the known types of clothes dryers now present in the prior art, the present invention provides a new portable clothes dryer construction wherein the same can be utilized for drying clothing while on vacation or camping.

The general purpose of the present invention, which will be described subsequently in greater detail, is to provide a new portable clothes dryer apparatus and method which has many of the advantages of the clothes dryers mentioned heretofore and many novel features that result in a new portable clothes dryer which is not anticipated, rendered obvious, suggested, or even implied by any of the prior art clothes dryers, either alone or in any combination thereof.

To attain this, the present invention generally comprises a dryer housing with first and second ends, a sidewall extending horizontally between the ends, and an interior that is defined by the sidewall and ends. The first end of the dryer housing has a door for inserting clothing into the interior of the dryer housing. The dryer housing has an inlet aperture extending through it for receiving a blower that has a heating element and a fan coupled to a fan motor. A basket drum is rotatably disposed in the interior of the dryer housing for tumbling clothing. A basket motor is mounted to the dryer housing for rotating the basket drum.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable clothes dryer apparatus and method which has many of the advantages of the clothes dryers mentioned heretofore and many novel features that result in a new portable clothes dryer which is not anticipated, rendered obvious, suggested, or even implied by any of the prior art clothes dryers, either alone or in any combination thereof.

It is another object of the present invention to provide a new portable clothes dryer which may be easily and efficiently manufactured and marketed.

It is a further object of the present invention to provide a new portable clothes dryer which is of a durable and reliable construction.

An even further object of the present invention is to provide a new portable clothes dryer which is susceptible of a low cost of manufacture with regard to both materials and labor, and which accordingly is then susceptible of low prices of sale to the consuming public, thereby making such portable clothes dryer economically available to the buying public.

Still yet another object of the present invention is to provide a new portable clothes dryer which provides in the apparatuses and methods of the prior art some of the advantages thereof, while simultaneously overcoming some of the disadvantages normally associated therewith.

Still another object of the present invention is to provide a new portable clothes dryer for drying clothing while on vacation or camping.

Yet another object of the present invention is to provide a new portable clothes dryer which includes a dryer housing with first and second ends, a sidewall extending horizontally between the ends, and an interior that is defined by the sidewall and ends. The first end of the dryer housing has a door for inserting clothing into the interior of the dryer housing. The dryer housing has an inlet aperture extending through it for receiving a blower that has a heating element and a fan coupled to a fan motor. A basket drum is rotatably disposed in the interior of the dryer housing for tumbling clothing. A basket motor is mounted to the dryer housing for rotating the basket drum.

Still yet another object of the present invention is to provide a new portable clothes dryer that permits interchangeable replacement of the heating element and blower fan with a hair dryer.

Even still another object of the present invention is to provide a new portable clothes dryer that provides a convenient means for drying clothing such as swimsuits, undergarments, and shoes while on vacation away from home.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
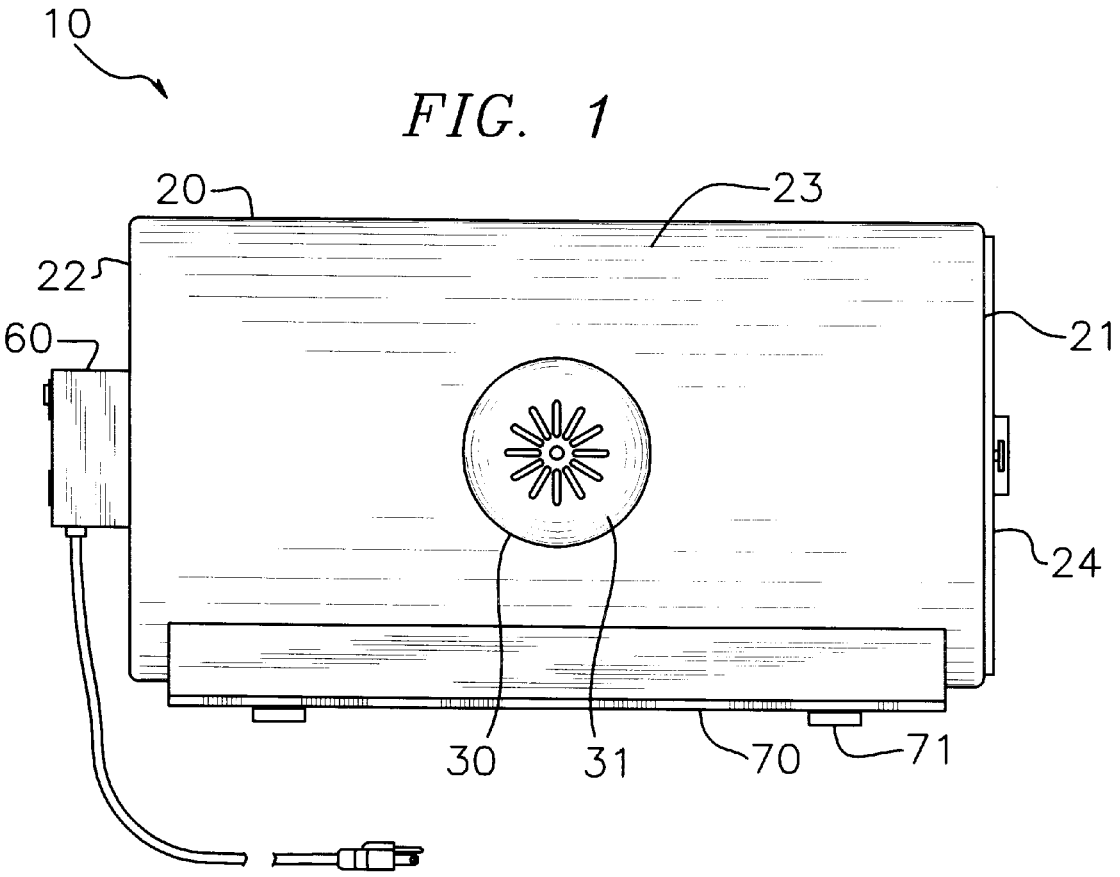
FIG. 1 is a schematic side view of a new portable clothes dryer according to the present invention.
Figure 2:
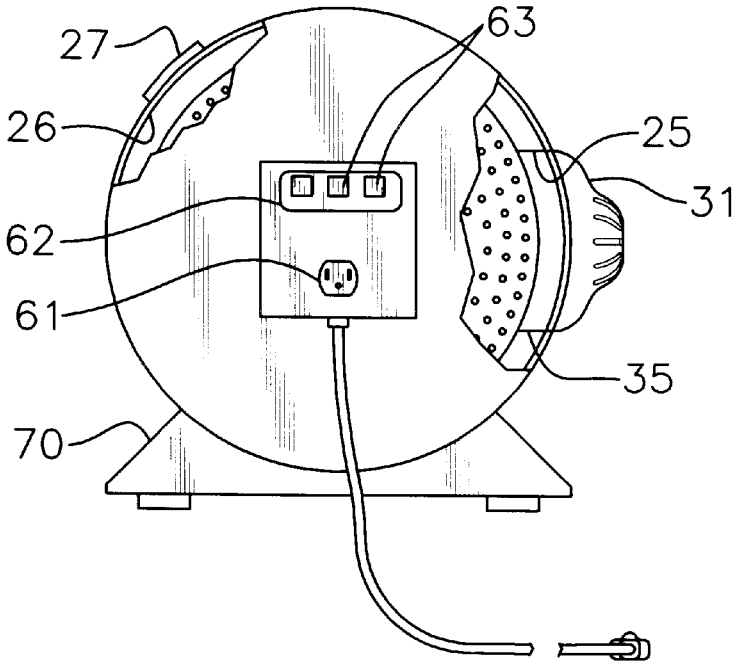
FIG. 2 is a schematic side view of the present invention.
Figure 3:
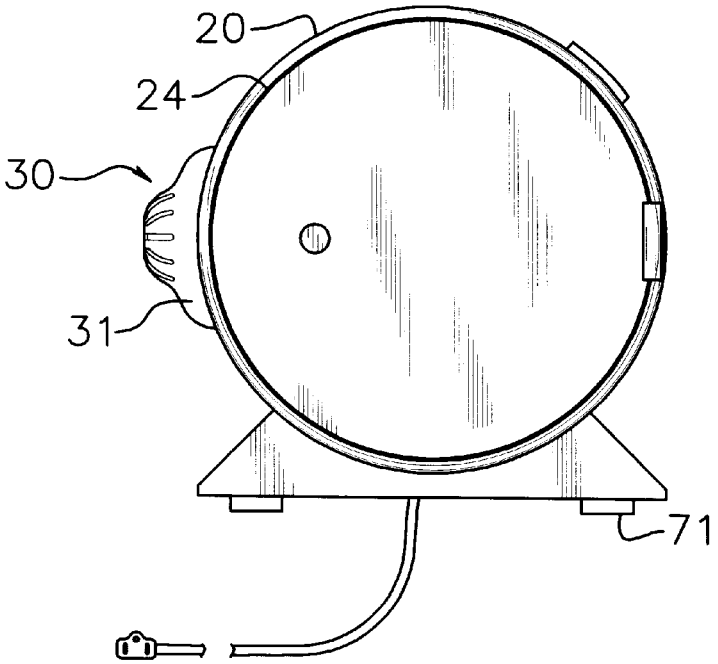
FIG. 3 is a schematic side view of the present invention.
Figure 4:
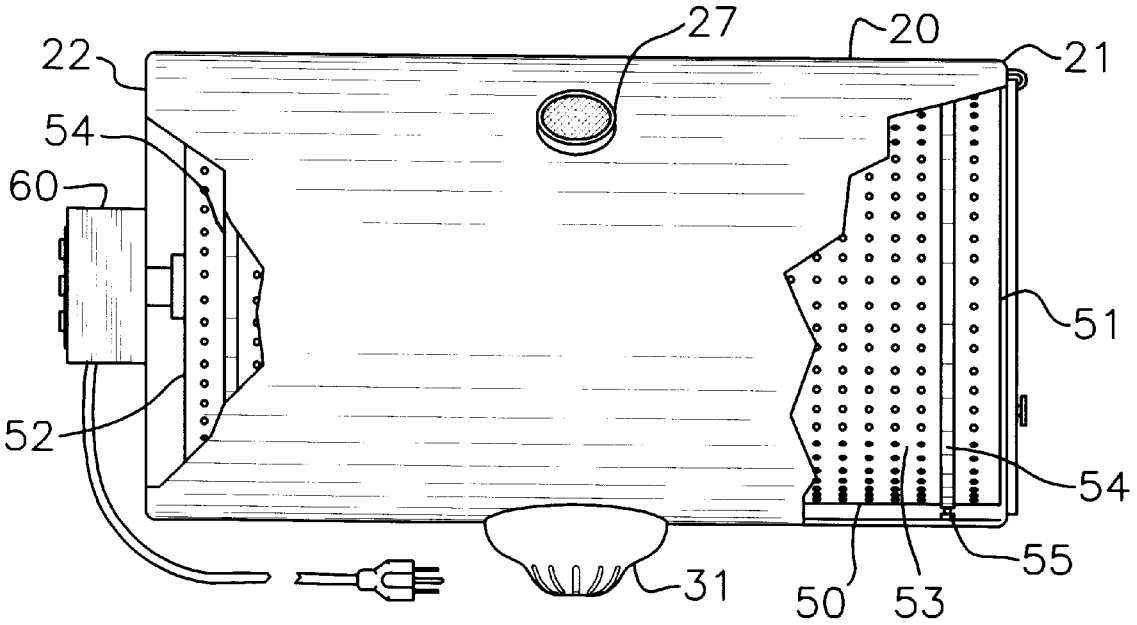
FIG. 4 is a schematic breakaway top view of the present invention.

With reference now to the drawings, and in particular to FIGS. 1 through 6 thereof, a new portable clothes dryer embodying the principles and concepts of the present invention and generally designated by the reference numeral 10 will be described.

As best illustrated in FIGS. 1 through 6, the portable clothes dryer 10 generally comprises a dryer housing 20 with first and second ends 21,22, a sidewall 23 extending horizontally between the ends 21,22, and an interior that is defined by the sidewall 23 and ends 21,22. The first end 21 of the dryer housing 20 has a door 24 for inserting clothing into the interior of the dryer housing 20. The dryer housing 20 has an inlet aperture 25 extending through it for receiving a blower 30 that has a blower housing 31, a heating element (not shown) and a fan (not shown) coupled to a fan motor (not shown). A basket drum 50 is rotatably disposed in the interior of the dryer housing 20 for tumbling clothing. A basket motor 65 is mounted to the dryer housing 20 for rotating the basket drum 50.

Preferably, the sidewall 23 of the dryer housing 20 is generally cylindrical. In the preferred embodiment, the length of the sidewall 23 between the ends 21,22 is between about 18 and 36 inches, ideally 24 to 30 inches. The inner diameter of the sidewall 23 is between about 8 and 24 inches, ideally 12 to 14 inches.

Preferably the inlet aperture 25 detachably receives the blower housing 31. Also preferably, the blower housing 31 has an inner diameter substantially equal to the diameter of the inlet aperture 25 to permit the maximum amount of heated air through the inlet aperture 25.

Ideally, a pin and socket assembly 66 permits releasable electrical coupling of the blower motor and the heating element to the housing to provide the advantage of not having to plug the blower motor and heating element in separately. The pin and socket assembly are in electrical communication with an electrical source 67 by wires 68. Most ideally, the wires are coupled to the inner surface of the dryer housing 20. In the preferred embodiment, the blower housing 31 has the plurality of pins extending from it, while the sidewall 23 of the housing has a plurality of electrical sockets for receiving the pins of the blower housing 31.

Figure 5:
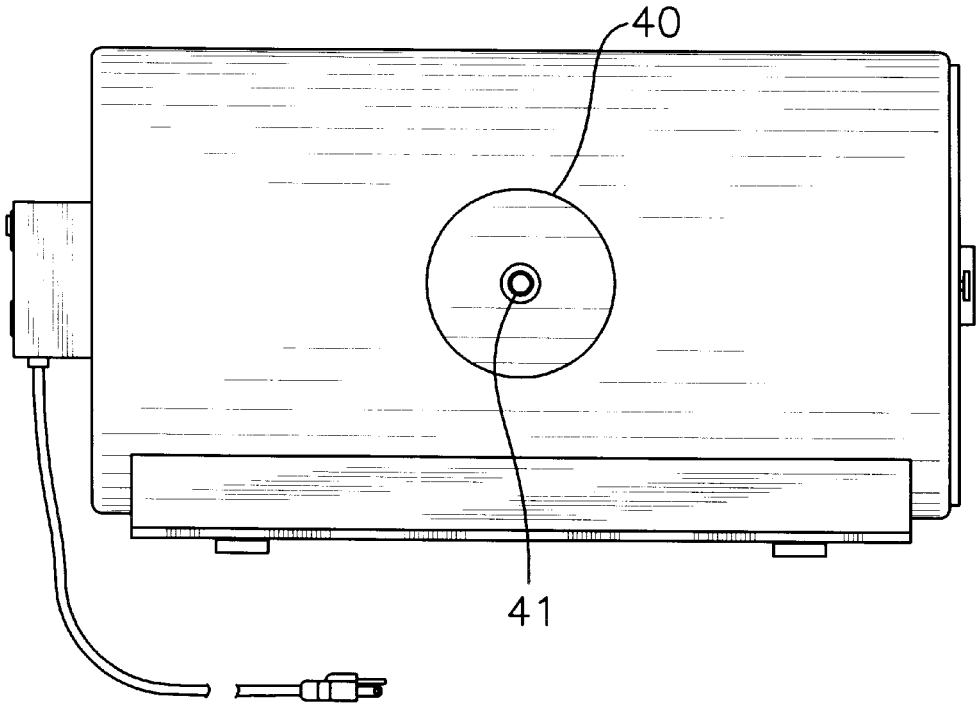
FIG. 5 is a schematic side view of the present invention.
Figure 6:
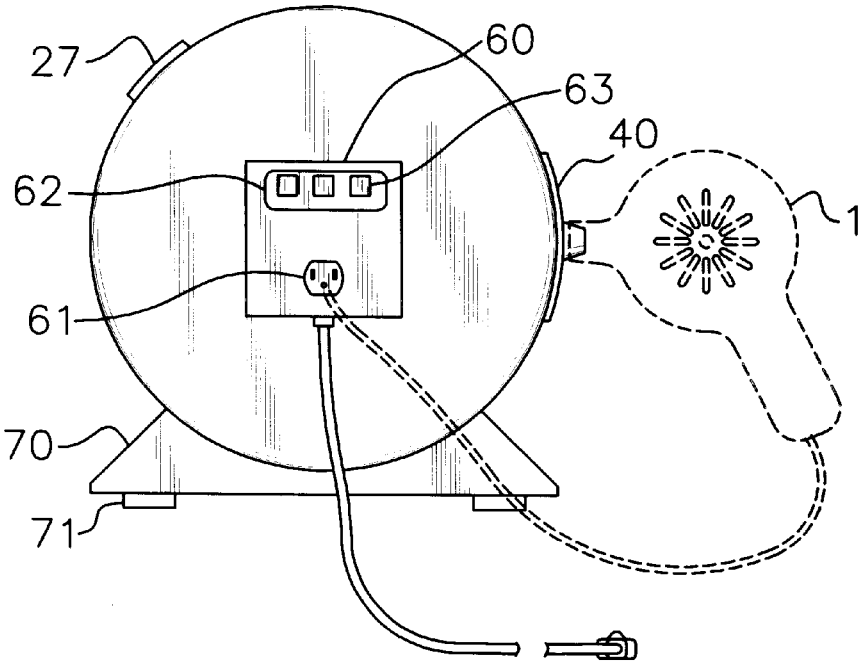
FIG. 6 is a schematic side view of the present invention.

Preferably, as shown in FIGS. 5 and 6, a plate member 40 may be detachably coupled to the sidewall 23 of the dryer housing 20 adjacent the inlet aperture 25. The plate member 40 has an inlet opening 41 that is adapted to receive and retain an outlet nozzle of a hairdryer 1.

Also preferably, the sidewall 23 of the dryer housing 20 has an outlet aperture 26 that extends therethrough to permit escape of air from the interior of the dryer housing 20. An outlet screen 27 that extends across the outlet aperture 26 may be removably coupled to the sidewall 23 of the dryer housing 20 to catch lint.

Preferably, the inlet aperture 25 of the sidewall 23 of the dryer housing 20 is positioned about 90 degrees from the vertical. The outlet aperture 26 of the sidewall 23 of the dryer housing 20 is positioned at an angle of about 135 degrees from the inlet aperture 25.

Also preferably, the basket drum 50 is generally cylindrical and has an open end 51, a closed end 52, a generally cylindrical holed wall 53 extending between the open and closed ends 51,52, and an interior that is defined by the holed wall 53 and the open and closed ends 51,52. Ideally, the basket drum 50 is removable from the dryer housing 20 through the door 24 to permit easier cleaning of the basket drum 50 and interior of the dryer housing 20.

In the preferred embodiment, the holed wall 53 of the basket drum 50 has at least one bearing band 54 extending around it. The basket drum 50 is suspended in the interior of the dryer housing 20 by a plurality of bearings 55 or rollers that extend from the sidewall 23 of the dryer housing 20 and rotatably engage the bearing band 54 of the holed wall 53 of the basket drum 50. Ideally, at least one bearing band 54 is positioned towards the open end 51 of the basket drum 50. More ideally, a second bearing band 54 is positioned towards the closed end 52.

Preferably, the sidewall 23 of the dryer housing 20 has a generally circular baffle 35 encircling the inlet aperture 25 of the sidewall 23 and extending into the interior of the dryer housing 20 such that the baffle 35 slidably engages the basket drum 50 to direct the air passing from the inlet aperture 25 into the interior of the basket drum 50 through holes in the holed wall 53 to promote efficiency by helping prevent air passage through the space between the holed wall 53 of the basket drum 50 and the sidewall 23 of the basket housing.

The basket motor 65 is mounted to the second end 22 of the dryer housing 20. Preferably, the basket motor is encased in a motor housing 60. The motor housing 60 has an outlet 61 thereon that is in communication with a power source. The outlet 61 receives an electrical plug of the hairdryer 1 when the hairdryer 1 is being used as the source for the heated air.

Also preferably, a timer 62 is coupled to the motor housing 60 to permit selective disconnection of the power source from the blower motor, the heating element, the outlet 61, and the basket motor after a predetermined amount of time has elapsed. The timer 62 has control buttons 63 that extend from the motor housing 60 for setting the timer 62.

In an exemplary embodiment, a generally frusto-conically shaped base portion 70 extends downwardly from the sidewall 23 of the dryer housing 20 to support the dryer housing 20 in a spaced apart relation from a surface. Ideally, the base portion 70 has a plurality of rubber pads 71 that are coupled to its lower surface inwardly of the corners of the lower surface. The pads prevent the base portion 70 from sliding along the surface when the basket motor is rotating the basket drum 50, as caused by vibration, and for providing a layer of thermal insulation between the base portion 70 and the surface. In the preferred embodiment, four pads are provided on the base portion 70. Ideally, the pads are between about 1/16 and 3/4 inch, ideally 1/4 inch.

In use, clothing is placed in the basket drum 50. The basket motor and the blower 30 is turned on. Heated air is directed into the interior of the basket drum 50 by the baffle 35. The timer 62 is set to turn off the basket motor and blower 30 after a predetermined amount of time has elapsed. Alternatively, the blower 30 may be removed from the inlet aperture 25 and the plate member 40 coupled to the dryer housing 20. The outlet nozzle of a hairdryer 1 is retained in the inlet opening 41. The hairdryer 1 may be plugged into the outlet 61 of the motor housing 60 so that the timer 62 cuts off power to the hairdryer after a predetermined amount of time has elapsed.

The portable clothes dryer 10 is primarily adapted for drying clothing while on vacation or camping, but may be utilized in places where a full-sized dryer would be too space consuming, such as in small apartments or nursing homes. The portable clothes dryer 10 would eliminate the hassle and damage to clothing caused by manually wringing garments and hanging them on, for example, a bathroom curtain rod, door knob, or chair back. The portable clothes dryer 10 would also be quite useful for drying clothing while camping, especially on a day when line drying is impossible, such as, for example, on a rainy day. The portable clothes dryer 10 could also help prevent wear and tear on delicate garments by gently using the blow dryer to dry them.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A clothes dryer, comprising:

a dryer housing having first and second ends, a sidewall extending horizontally between said ends, and an interior being defined by said sidewall and end;

said first end of said dryer housing having a door for inserting clothing into said interior of said dryer housing;

said dryer housing having an inlet aperture extending therethrough, said first aperture receiving a blower having a blower housing, a heating element and a fan coupled to a fan motor;

a basket drum being rotatably disposed in said interior of said dryer housing for tumbling clothing therein; and a basket motor mounted to said dryer housing for rotating said basket drum, said basket motor being in communication with said basket drum;

wherein said aperture detachably receives said blower housing; and wherein a pin and socket assembly permits releasable electrical coupling of said blower motor and said heating element to said housing, said pin and socket assembly being in electrical communication with an electrical source.

2. The clothes dryer of claim 1 wherein said sidewall is generally cylindrical, wherein the length of said sidewall between said ends is between about 18 and 36 inches, wherein the inner diameter of said sidewall is between about 8 and 24 inches.

3. The clothes dryer of claim 1, wherein said, sidewall of said housing has an outlet aperture extending therethrough for permitting escape of air from said interior of said housing, an outlet screen being removably coupled to said sidewall of said dryer housing and extending across said outlet aperture for catching lint.

4. The clothes dryer of claim 1, wherein said basket drum is removable from said dryer housing.

5. The clothes dryer of claim 1, wherein said basket drum has an open end, a closed end, a generally cylindrical holed wall extending between said open and closed ends, and an interior being defined by a holed wall and said open and closed ends, said holed wall of said basket drum having at least one bearing band extending therearound, said basket drum being suspended in said interior of said dryer housing by a plurality of bearings being extended from said sidewall of said dryer housing and rotatably engaging said bearing band of said holed wall of said basket drum.

6. The clothes dryer of claim 1, wherein a base portion of said dryer housing has a plurality of rubber pads being coupled to a lower surface thereof inwardly of corners thereof, said pads being for preventing said base portion from sliding along a surface when said basket motor is rotating said basket drum and for providing a layer of thermal insulation between said base portion and said surface.

7. A clothes dryer, comprising:

a dryer housing having first and second ends, a sidewall extending horizontally between said ends, and an interior being defined by said sidewall and ends;

said first end of said dryer housing having a door for inserting clothing into said interior of said dryer housing;

said dryer housing having an inlet aperture extending therethrough, said aperture receiving a blower having a blower housing, a heating element and a fan coupled to a fan motor;

a basket drum being rotatable disposed in said interior of said dryer housing for tumbling clothing therein; and a basket motor mounted to said dryer housing for rotating said basket drum, said basket motor being in communication with said basket drum;

wherein said first aperture detachable receives said blower housing; and a plate member having an inlet opening being adapted for receiving and retaining an outlet nozzle of a hairdryer, said plate member being for detachable coupling to said sidewall of said dryer housing adjacent said inlet aperture.

8. A clothes dryer, comprising;

a dryer housing having first and second ends, a sidewall extending horizontally between said ends, and an interior being defined by said sidewall and ends;

said first end of said dryer housing having a door for inserting clothing into said interior of said dryer housing;

said dryer housing having an inlet aperture extending therethrough, said aperture receiving a blower having a blower housing, a heating element and a fan coupled to a fan motor;

a basket drum being rotatably disposed in said interior of said dryer housing for tumbling clothing therein; and a basket motor mounted to said dryer housing for rotating said basket drum, said basket motor being in communication with said basket drum; and wherein said sidewall of said dryer housing has a generally circular baffle encircling said inlet aperture of said sidewall and being extended into said interior of said dryer housing such that said baffle slidably engages said basket drum for directing air passing from said inlet aperture into said interior of said basket drum through holes in a holed wall of said basket drum to help prevent air passage through a space between said holed wall of said basket drum and said sidewall of said basket housing.

9. The clothes dryer of claim 8, wherein said sidewall of said housing has an outlet aperture extending therethrough for permitting escape of air from said interior of said housing, an outlet screen being removably coupled to said sidewall of said dryer housing and extending across said outlet aperture for catching lint.

10. The clothes dryer of claim 8, wherein said basket drum is removable from said dryer housing.

11. The clothes dryer of claim 8, wherein said basket drum has an open end, a closed end, a generally cylindrical holed wall extending between said open and closed ends, and an interior being defined by a holed wall and said open and closed ends, said holed wall of said basket drum having at least one bearing band extending therearound, said basket drum being suspended in said interior of said dryer housing by a plurality of bearings being extended from said sidewall of said dryer housing and rotatably engaging said bearing band of said holed wall of said basket drum.

12. The clothes dryer of claim 8, wherein a base portion of said dryer housing has a plurality of rubber pads being coupled to a lower surface thereof inwardly of corners thereof, said pads being for preventing said base portion from sliding along a surface when said basket motor is rotating said basket drum and for providing a layer of thermal insulation between said base portion and said surface.

13. A clothes dryer, comprising;

a dryer housing having first and second ends, a sidewall extending horizontally between said ends, and an interior being defined by said sidewall and ends;

said first end of said dryer housing having a door for inserting clothing into said interior of said dryer housing;

said dryer housing having an inlet aperture extending therethrough, said aperture receiving a blower having a blower housing, a heating element and a fan coupled to a fan motor;

a basket drum being rotatable disposed in said interior of said dryer housing for tumbling clothing therein; and a basket motor mounted to said dryer housing for rotating said basket drum, said basket motor being in communication with said basket drum; and wherein said basket motor is encased in a motor housing, said motor housing having an outlet thereon being in communication with a power source.

14. The clothes dryer of claim 13, further comprising a timer being coupled to said motor housing for permitting disconnection of said power source from said blower motor, said heating element, said outlet, and said basket motor after a predetermined amount of time has elapsed, said timer having control buttons being extended from said motor housing for setting said timer.

15. A clothes dryer, comprising;

a dryer housing having first and second ends, a sidewall extending horizontally between said ends, and an interior being defined by said sidewall and ends;

said first end of said dryer housing having a door for inserting clothing into said interior of said dryer housing;

said dryer housing having an inlet aperture extending therethrough, said aperture receiving a blower having a blower housing, a heating element and a fan coupled to a fan motor;

a basket drum being rotatably disposed in said interior of said dryer housing for tumbling clothing therein; and a basket motor mounted to said dryer housing for rotating said basket drum, said basket motor being in communication with said basket drum; and a generally frusto-conically shaped base portion being extended from said sidewall of said dryer housing, said base portion being for supporting said dryer housing in a spaced apart relation from a surface.

16. The clothes dryer of claim 15, wherein said sidewall of said housing has an outlet aperture extending therethrough for permitting escape of air from said interior of said housing, an outlet screen being removably coupled to said sidewall of said dryer housing and extending across said outlet aperture for catching lint.

17. The clothes dryer of claim 15, wherein said basket drum is removable from said dryer housing.

18. The clothes dryer of claim 15, wherein said basket drum has an open end, a closed end, a generally cylindrical holed wall extending between said open and closed ends, and an interior being defined by a holed wall and said open and closed ends, said holed wall of said basket drum having at least one bearing band extending therearound, said basket drum being suspended in said interior of said dryer housing by a plurality of bearings being extended from said sidewall of said dryer housing and rotatably engaging said bearing band of said holed wall of said basket drum.

19. The clothes dryer of claim 15, wherein a base portion of said dryer housing has a plurality of rubber pads being coupled to a lower surface thereof inwardly of corners thereof, said pads being for preventing said base portion from sliding along a surface when said basket motor is rotating said basket drum and for providing a layer of thermal insulation between said base portion and said surface.

20. A clothes dryer, comprising;

a dryer housing having first and second ends, a generally cylindrical sidewall extending horizontally between said ends, and an interior being defined by said sidewall and ends, wherein the length of said sidewall between said ends is between about 18 and 36 inches, wherein the inner diameter of said sidewall is between about 8 and 24 inches;

said first end of said dryer housing having a door for inserting clothing into said interior of said dryer housing;

said sidewall of said dryer housing having an inlet aperture extending therethrough;

said inlet aperture detachably receiving a blower having a blower housing heating element and a fan coupled to a fan motor;

wherein a pin and socket assembly permits releasable electrical coupling of a blower motor and said heating element to said housing, said pin and socket assembly being in electrical communication with an electrical source;

a plate member having an inlet opening being adapted for receiving and retaining an outlet nozzle of a hairdryer, said plate member being for detachable coupling to said sidewall of said dryer housing adjacent said inlet aperture;

said sidewall of said housing having an outlet aperture extending therethrough for permitting escape of air from said interior of said housing;

an outlet screen being removably coupled to said sidewall of said dryer housing and extending across said outlet aperture for catching lint;

a generally cylindrical basket drum being rotatably disposed in said interior of said dryer housing for tumbling clothing therein, said basket drum having an open end, a closed end, a generally cylindrical holed wall extending between said open and closed ends, and an interior of said basket drum being defined by said holed wall and said open and closed ends, said basket drum being removable from said dryer housing;

said holed wall of said basket drum having at least one bearing band extending therearound;

said basket drum being suspended in said interior of said dryer housing by a plurality of bearings being extended from said sidewall of said dryer housing and rotatably engaging said bearing band of said holed wall of said basket drum;

a basket motor mounted to said second end of said dryer housing, said basket motor being in communication with said basket drum;

wherein said sidewall of said dryer housing has a generally circular baffle encircling said inlet aperture of said sidewall and being extended into said interior of said dryer housing such that said baffle slidably engages said basket drum for directing the air passing from said inlet aperture into said interior of said basket drum through holes in said holed wall to help prevent air passage through the space between said holed wall of said basket drum and said sidewall of said basket housing;

said basket motor being encased in a motor housing;

said motor housing having an outlet thereon being in communication with a power source, said outlet being for receiving an electrical plug of said hairdryer;

a timer being coupled to said motor housing for permitting disconnection of said power source from a blower motor, said heating element, said outlet, and said basket motor after a predetermined amount of time has elapsed, said timer having control buttons being extended from said motor housing for setting said timer;

a generally frusto-conically shaped base portion being extended from said sidewall of said dryer housing, said base portion being for supporting said dryer housing in a spaced apart relation from a surface;

said base portion having a plurality of rubber pads being coupled to a lower surface thereof inwardly of corners thereof, said pads being for preventing said base portion from sliding along said surface when said basket motor is rotating said basket drum and for providing a layer of thermal insulation between said base portion and said surface.

* * * * *